United States Patent [19]

Goodman, Jr. et al.

[11] 3,948,528

[45] Apr. 6, 1976

[54] TOTE BAG WITH ATTACHED, WRAP-AROUND GAME BOARD

[76] Inventors: Maurice Goodman, Jr., 177 E. 80th St., New York, N.Y. 10021; Robert G. Hammond, 440 E. 57th St., New York, N.Y. 10022; Angelo J. Molinari, 30 George Brown Place, Amity Harbor, N.Y. 11701

[22] Filed: June 5, 1975

[21] Appl. No.: 583,867

[52] U.S. Cl. ..... 273/136 GA; 273/136 K; 190/42

[51] Int. Cl.[2] ..... A63F 3/00

[58] Field of Search ..... 190/42; 150/35; 273/136 K, 273/136 D, 136 G, 136 C, 136 GA

[56] References Cited

UNITED STATES PATENTS

| | | | |
|---|---|---|---|
| 968,479 | 8/1913 | Jensen | 273/136 K |
| 1,549,610 | 8/1925 | Reisz | 273/136 D |
| 2,364,814 | 12/1944 | Plummer | 273/136 C |
| 2,667,353 | 1/1954 | Lanice | 273/136 GA |
| 3,092,223 | 6/1963 | Martin | 190/42 |
| 3,139,281 | 6/1964 | Nicholson | 273/136 G |
| 3,204,678 | 9/1965 | Worcester | 190/42 |
| 3,623,728 | 11/1971 | Goldfarb | 273/136 R |

*Primary Examiner*—Anton O. Oechsle
*Assistant Examiner*—Marvin Siskind
*Attorney, Agent, or Firm*—I. Jordan Kunik

[57] ABSTRACT

A carrying bag or tote bag to the exterior sides of which is removably attached a flexible wrap-around element which, on its exterior surface, is impressed or otherwise applied the design of a game board, or the like. The wrap-around element can be detached from the bag and extended flat on a suitable plane surface to form a game board upon which the game can be played. The design of the game board on the wrap-around element serves also as a decorative feature of the bag.

7 Claims, 5 Drawing Figures

TOTE BAG WITH ATTACHED, WRAP-AROUND GAME BOARD

BACKGROUND OF THE INVENTION

1. Field of the Invention:

This invention relates to portable handbags and tote bags and, more particularly, to a portable device which serves both the function of carrying various personal articles and the like and having a removable wrap-around element with a game board design impressed thereon for playing the game.

2. Description of the Prior Art:

In previous devices for providing a portable game for the convenience of playing the game in different locations, and where the game board is formed in a hinged manner in order to serve as a closure for game pieces and other objects to be carried therein, the act of spreading out the foldable game apparatus obliterates the article-carrying function of the apparatus. Some examples of typical and comparable devices have been disclosed in the following U.S. Pat. Nos. 1,269,276, 1,641,104, 2,479,203, 2,667,353, and Italian Pat. No. 465,570.

SUMMARY OF THE INVENTION

The drawbacks of prior art devices have been overcome by the present invention disclosed and claimed herein by providing a regular pouch or bag, the interior of which serves the purpose of carrying various articles of personal and general use. Removably attached by suitable fastening elements to the exterior side surfaces of the bag is a removable wrap-around element made of a suitable flexible fabric material such as woven or non-woven cloth, composition material, various plastics, or the like.

Impressed upon the outer surface of the wrap-around element or sheath is a pattern or design of a game board such as backgammon, or the like. The game board design or pattern provides decorative enhancement for the assembled bag and wrap-around sheath. When it is desired to play the game, the wrap-around element is removed from the bag and laid out on a suitable flat surface whereby the players can play the game at will and in any location where they happen to be.

The game pieces, or counters, dice, and dice cups may be stored in the interior of the pouch or bag, or in a separate pocket compartment sewn or otherwise fixed into the interior of the bag to keep them readily accessible and separate from the other general contents thereof.

Although the illustrations of the drawing disclose the design or pattern of a backgammon board impressed upon the wrap-around element, it is contemplated within the purview of the present invention that other types of game board patterns may be impressed thereon for both utilitarian game playing and decorative purposes.

These and other novel features and advantages of the present invention will be described and defined in the following specification and claims.

BRIEF DESCRIPTION OF THE DRAWINGS

FIG. 3 is a side view of the bag with the wrap-around element removed and with a side wall of the bag broken away to disclose a separate pouch in the interior of the bag for carrying the game pieces, or the like;

DESCRIPTION OF THE PREFERRED EMBODIMENTS

Figure 1:
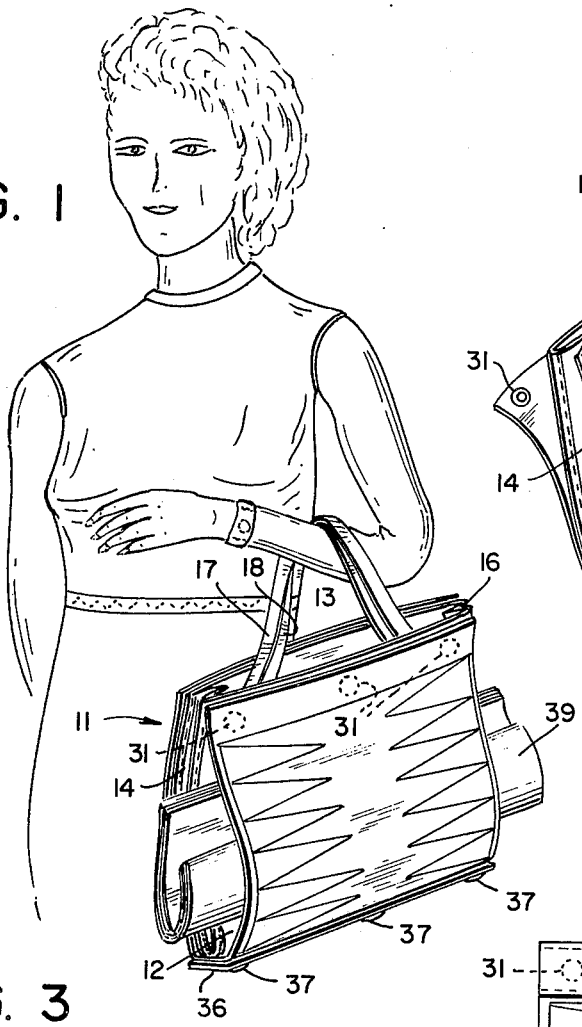
FIG. 1 is a perspective view of the portable game bag of the present invention as carried on the arm of the user.

Referring now to the drawing in detail, FIG. 1 shows a woman carrying the portable game bag of the present invention, said bag being generally designated with the numeral 11. The game bag 11 comprises generally an assembly of two components, namely, a conventional carrying bag or pouch that consists of a pair of opposing side walls 12 and 13, respectively, and bounded at opposite ends by means of flexible gussets 14 and 16, respectively, connected to side walls 12 and 13 by suitable means such as stitching, or the like. If the bag portion of the portable game bag is made of a plastic material, gussets 14 and 16 may be secured to respective ends of side walls 12 and 13 by means of heat sealing or the like. Attached to the top portion of side wall 12 and to the top portion of side wall 13 are respective straps 17 and 18 through which the arm of the person may extend, as shown in FIG. 1. In some embodiments, straps 17 and 18 may be elongated so as to serve as shoulder straps which rest upon the shoulder of the woman. The pouch portion of the bag, namely, side walls 12 and 13 and gussets 14 and 16, may be made of any suitable fabric material such as cotton, burlap, wool, linen, leather, plastics, or the like.

Figure 4:
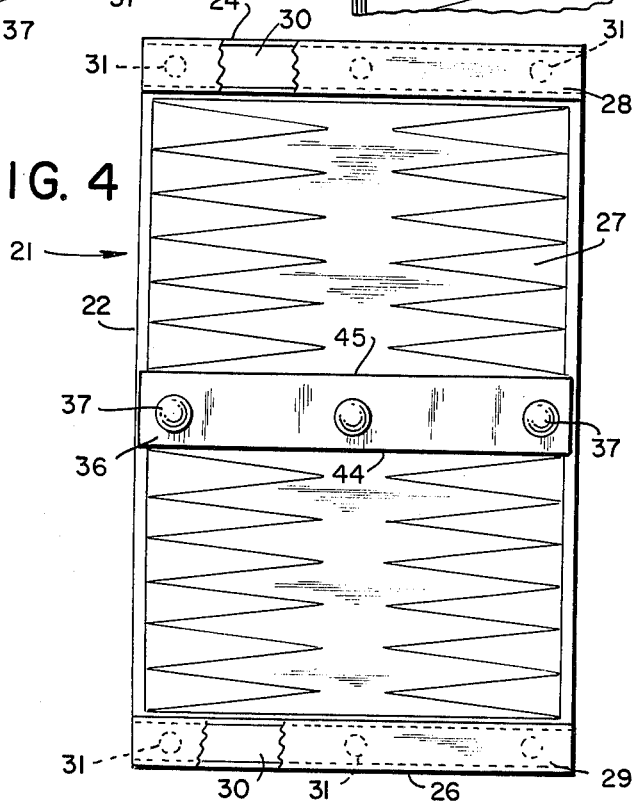
FIG. 4 is a plan view of the outer wrap-around element of the tote bag shown in the other Figures as laid out on a flat surface for playing the backgammon game.

Wrapped around side walls 12 and 13 of the pouch portion of the portable game bag is a removable, flexible element generally designated 21 and shown in a flat position in FIG. 4. The flexible game board element 21 is generally rectangular in shape with spaced side edges 22 and 23 and spaced end edges 24 and 26. Impressed upon the outer surface of element 21 is the ornamental design or pattern of a game, generally designated 27, such as backgammon, or the like. The game board element 21 may be made of any suitable fabric similar to or different from that of the bag or tote pouch. The game board element 21 may be placed flat upon any suitable surface so that two or more players may play the game impressed upon said board.

Figure 2:
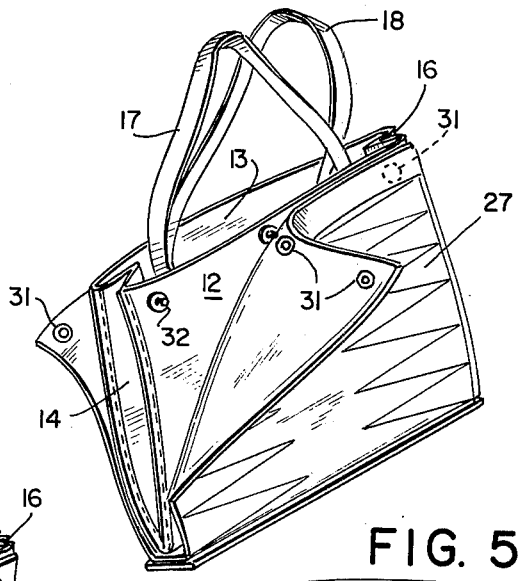
FIG. 2 is a perspective view of the bag somewhat similar to that shown in FIG. 1 and illustrating the manner in which the outer game board wrap-around element is partially detached from the bag.

As illustrated in FIGS. 1, 2 and 4, the backgammon game pattern or design is imprinted or otherwise applied by suitable means to the surface of the game board 21. In some embodiments, the design may be woven integrally into the fabric of the game board element if the latter is made of a woven material. In other embodiments, the game board pattern may be painted or stencilled directly upon the fabric material or may take the form of separate shaped elements made of leather or plastics such as vinyl material and bonded firmly by suitable adhesive means to the fabric to make up the ornamental game pattern or design.

The end portions 28 and 29 of the game board 21 may be reinforced with a suitable stiffening element 30 securely bound within the material or overlapped therein so as to serve as a suitable weighting for the board to rest flat in a stable position where it is placed. Furthermore, the end portions are provided with a plurality of spaced snap buttons 31 which cooperate with corresponding spaced snap elements 32 located in the respective top end portions of walls 12 and 13 of the bag. The respective paired snap buttons 31 and 32 serve to detachably secure the game board element 21 to the tote bag 11, as shown in FIGS. 1 and 2.

Figure 5:
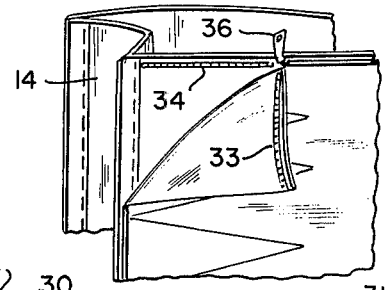
FIG. 5 is a fragmentary view of another embodiment of the bag in which a slide closure element or "zipper" is substituted for the detachable snap buttons shown in FIGS. 1, 2 and 3.

In some embodiments, snap fasteners 31 and 32 may be replaced by cooperating buttons and buttonholes or by cooperating slide fastener elements 33 and 34 in game element 21, and the tote bag, respectively, whereby said slide fastener element may be releasably secured together by the slider tab 36 as shown in FIG. 5.

Located on the outside surface of and intermediate the ends of game board 21 is a laterally extending rigid or semi-rigid bar 36 which is secured thereto by means of a plurality of spaced studs 37. Game board 21 not only serves as a requisite partition for the backgammon game (FIG. 4) but also provides a useful and protective resting base for the entire portable game bag.

When game board 21 is assembled with the bag 11 as shown in FIG. 1, and when both of these components are made of somewhat flexible materials, the space between the inner surface of the game board 21 and the outer surfaces of walls 12 and 13 may be utilized to carry such articles 39 as newspapers, magazines, folding unbrellas, and the like.

Figure 3:
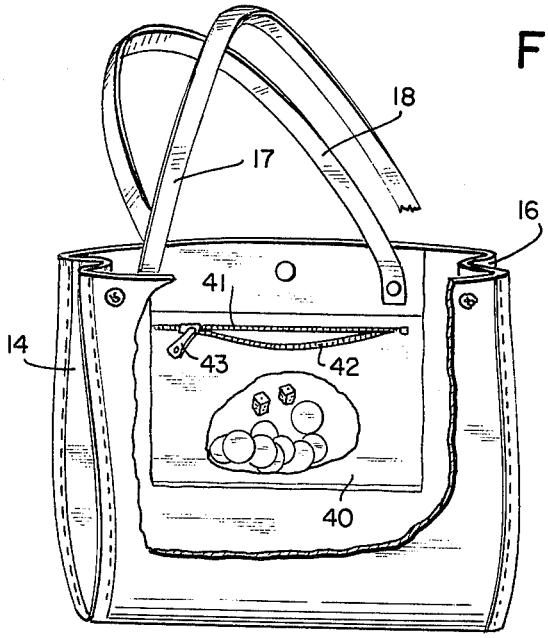

In some embodiments, provision can be made for safe-keeping of the game pieces, counters, cups, dice, and the like, by mounting in the interior wall 13 of the bag a fabric pocket 40 as shown in FIG. 3. Pocket 40 may be provided with closure means such as slide fastener elements 41 and 42 that are releasably connected by means of slide tab 43.

It is also contemplated within the purview of the present invention that wrap-around element 21 be made of a comparatively stiff material which would be provided with hinged elements at the respective elongated edges 44 and 45 of bar 36.

Although the present invention has been described with reference to particular embodiments and examples, it will be apparent to those skilled in the art that variations and modifications can be substituted therefor without departing from the principles and true spirit of the invention. The "Abstract" given above is for the convenience of technical searchers and is not to be used for interpreting the scope of the invention or claims.

We claim:

1. The combination game and container comprising a bag having two opposing side walls and opposing end walls to form an enclosure, a separate wrap-around element, said element encircling the exterior of said bag and the end portions of said element being detachably secured to the respective top edge portions of said side walls, the exposed surface of said wrap-around element having impressed thereon the design of a board game, said board game being playable when said wrap-around element is detached from said bag and laid flat upon a suitable surface.

2. The combination according to claim 1 and further comprising a bar element secured to the external surface of said wrap-around element intermediate the ends thereof, said bar element forming a requisite structure for the playing of said game when said wrap-around element is laid flat on a suitable surface, as well as providing a resting base for said bag when said wrap-around element is secured to said bag.

3. The combination according to claim 1 wherein the wrap-around element is flexible and the respective side walls of said bag are flexible, said wrap-around element when secured to said bag forming carrying spaces between said wrap-around element and the said respective walls for the purpose of removably supporting various objects therein.

4. The combination according to claim 1 wherein said wrap-around element is detachably secured to said bag by means of spaced snap fasteners.

5. The combination according to claim 1 wherein said wrap-around element is detachably secured to said bag by means of slide fasteners.

6. The combination according to claim 1 and further comprising a stiffening element mounted on each of the respective end portions of said wrap-around element.

7. The combination according to claim 6 and further comprising a bar mounted on said wrap-around element intermediate the ends thereof, said bar and said stiffening elements together forming weights for stabilizing the wrap-around element when the latter is laid flat on a suitable surface.

* * * * *